United States Patent [19]

Nakamatsu

[11] 4,259,550

[45] Mar. 31, 1981

[54] ACOUSTIC DEVICE WITH FLOATING VIBRATING MEANS

[76] Inventor: Yoshiro Nakamatsu, 1-10-309, 5-chome, Minamiaoyama, Minato-ku, Tokyo, Japan

[21] Appl. No.: 29,234

[22] Filed: Apr. 11, 1979

[30] Foreign Application Priority Data

| | | | |
|---|---|---|---|
| Apr. 15, 1978 | [JP] | Japan | 53-43803 |
| Apr. 17, 1978 | [JP] | Japan | 53-44202 |
| Dec. 28, 1978 | [JP] | Japan | 53-161142 |
| Dec. 28, 1978 | [JP] | Japan | 53-161143 |
| Dec. 28, 1978 | [JP] | Japan | 53-161144 |

[51] Int. Cl.[3] ..... H04R 9/02

[52] U.S. Cl. ..... 179/115.5 VC

[58] Field of Search ..... 179/115 R, 115.5 R, 179/115.5 PC, 117, 119 R, 138, 181 R, 115.5 VC

[56] References Cited

U.S. PATENT DOCUMENTS

| | | | |
|---|---|---|---|
| 3,783,311 | 1/1974 | Sato et al. | 179/115.5 R X |
| 3,830,986 | 8/1974 | Yamamuro | 179/115.5 R |
| 3,855,428 | 12/1974 | Itagaki | 179/181 R X |
| 3,937,904 | 2/1976 | Parker | 179/117 X |
| 4,017,694 | 4/1977 | King | 179/115.5 VC |

FOREIGN PATENT DOCUMENTS

| | | | |
|---|---|---|---|
| 732299 | 4/1940 | Fed. Rep. of Germany | 179/115.5 R |

*Primary Examiner*—Robert S. Tupper
*Assistant Examiner*—Aristotelis M. Psitos
*Attorney, Agent, or Firm*—Jordan and Hamburg

[57] ABSTRACT

An acoustic device comprising a main body having a magnet attached thereto, a vibrating means disposed to cooperate with said magnet of said main body for converting an electrical vibration into a mechanical vibration or vice versa, and a means for floating up said vibrating means into disengagement with said main body.

12 Claims, 17 Drawing Figures

ACOUSTIC DEVICE WITH FLOATING VIBRATING MEANS

DETAILED DESCRIPTION

This invention relates to a novel and unique acoustic device and, more particularly, an audio instrument having a unique input or output which is obtained by the actuation of vibrating means floated up by means of a uniform flow of air or magnets.

Usually, an acoustic speaker includes a cone-shaped, vibrating plate firmly fixed to the main body of the speaker. A speaker constructed according to this invention includes a cone-shaped, vibrating plate floated up within a basket of the speaker into disengagement with the basket. Such a speaker will produce sounds having tonal qualities which have never been heard by anybody. In this invention, the cone-shaped, vibrating plate may be held away from the main body by means of air pressure or magnetic forces.

This invention may be applied to any acoustic instrument in which any vibrating element is utilized to convert an electrical vibration into a mechanical vibration or vice versa. For example, a microphone may have a voice-receiving member floated from the main body of the microphone, which member converts its mechanical movement into an electrical vibration as an output. Moreover, this invention may be applied to a cartridge for electric gramophones which has a needle vibrated mechanically by cooperating with a helical groove of a rotating disc.

This invention will now be described in more detail, by way of example, with reference to the accompanying drawings, in which.

Figure 1:
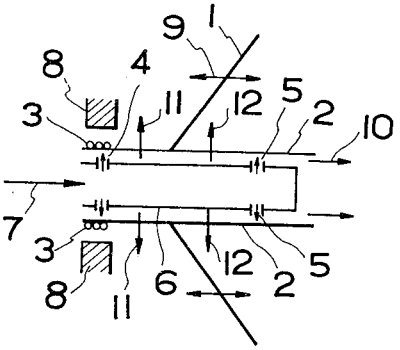
FIG. 1 is a schematically sectional view showing an acoustic speaker to which the principle of this invention is applied.

Referring to FIG. 1 an acoustic speaker constructed according to one aspect of this invention comprises a cone-shaped, vibrating plate 1 having a relatively long cylindrical member 2 formed therein which extends coaxially from the central axis of the vibrating plate 1. The cylindrical member 2 is located over a hollow column 6 which is mounted on a fixed main body (not shown) of the speaker. The hollow column 6 has one closed end and a plurality of small openings 4 and 5 (four in FIG. 1) which are formed on the side walls thereof in a spaced relationship along the longitudinal axis of the column 6. The cylindrical member 2 has an inner diameter only slightly larger than an outer diameter of the column 6.

The cylindrical member 2 has a rearward end (leftward end as viewed in FIG. 1) around the outer periphery of which a voice coil 3 is located in a well-known manner. The voice coil 3 is disposed to cooperate with magnet means 8 of the speaker which is fixed to the main body thereof.

When pressurized air is supplied into the column 6 through the open end thereof from a source (not shown) as shown by an arrow 7 in FIG. 1, the cylindrical member 2 and thus the cone-shaped, vibrating plate 1 is floated up away from the column 6 by the air which is discharged through the openings 4 and 5 of the column 6 in the cylindrical member 2. Thus, the vibrating plate 1 is held in the speaker construction, without contacting any fixed portion thereof, in such a direction as shown by reference numbers 11 and 12 in FIG. 1. The air which has been utilized to float the cylindrical member 2 is discharged outside as shown by reference number 10 in FIG. 1.

As being well known in the art, the cone-shaped, vibrating plate 1 produces sounds as an electrical vibration in the magnet 8 of the speaker is converted into a mechanical vibration of the floated cylindrical member 2 by the cooperation of the voice coil 3 with the magnet means 8 as shown by arrows 9 in FIG. 1.

In such an arrangement, the speaker produces an extremely large input and an output with no distortion and is remarkably durable since the vibrating plate is not completely mounted on the fixed main body of the speaker.

Figure 2:
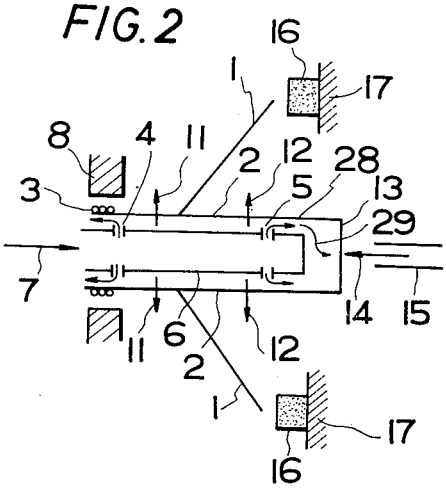
FIG. 2 is a view similar to FIG. 1, showing a slightly modified construction of the speaker.

FIG. 2 shows another embodiment of this invention in which the construction thereof is substantially identical with that of FIG. 1 except that the cone-shaped, vibrating plate 1 includes a cylindrical hollow member or tube 2 which has one end closed by an end plate 13. Thus, in FIG. 2, the same parts as in FIG. 1 are indicated by the same reference numbers. In this structure, the supplied air flows along such a path as shown by arrows 28 and 29 so that the cylindrical tube 2 will be forced rightwardly as viewed in FIG. 2. This arrangement is adopted for preventing the cylindrical member 2 from moving excessively leftwardly due to the flow of air 10 as in FIG. 1. Although the cylindrical tube 2 is prevented from moving excessively leftwardly by the air flow impinging aginst the inner wall of the end plate 13, an excessively rightward movement of the tube 2 must also be limited to position properly the voice coil 3 in the magnet 8 of the speaker. For this purpose, a pipe 15 is provided to blow another flow of air against the outer wall of the end plate 13 as shown by an arrow 14 in FIG. 2. Alternatively, any cushion member as shown by 16 may be provided on that portion 17 of the main body corresponding to the outer periphery of the vibrating plate 1. The construction of FIG. 2 is distinguished from that of FIG. 1 in that any air noise is removed as the air is discharged from the cylindrical member 2 and in that a consumption of pressurized air is decreased.

Figure 3:
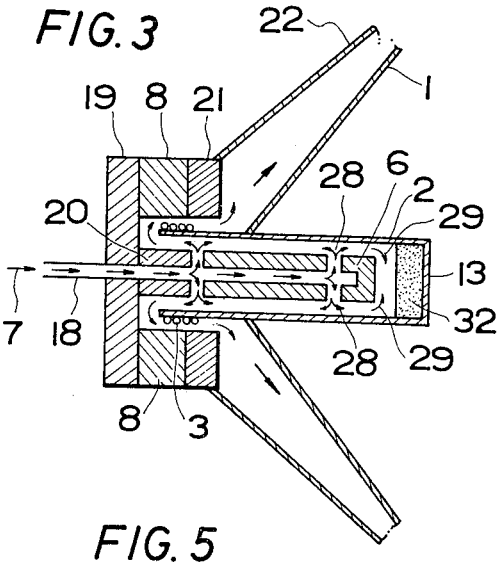
FIG. 3 is a sectional view showing a further modified construction of the speaker shown in FIG. 2.

FIG. 3 shows more concretely an acoustic speaker comprising stationary members 19 and 20 between which the magnet 8 is mounted. A cone-shaped basket 22 also is mounted on the stationary member 21. A column 6 projects from the stationary member 19 through the magnet 8 and the stationary member 21. The column 6 includes an air passage extending axially therein and side openings formed in the side walls of the column 6. A cone-shaped vibrating plate 1 includes similarly a cylindrical member 2 which is mounted coaxially thereon at the apex thereof and has an outer end closed by an end plate 13. The inner end of the cylindrical member 2 is provided with a voice coil 3 which is mounted therearound in any well-known manner.

The cylindrical member 2 is located coaxially over the column 6 so that it will be held by the air flowing as shown by arrows 7, 18, 28 and 29 in the same manner as in the previous embodiments.

In order to eliminate any noise which is produced when the end plate 13 of the member 2 is engaged by the tip portion of the column 6, a cushion member 32 may be located on the inner wall of the end plate 13

Figure 4:
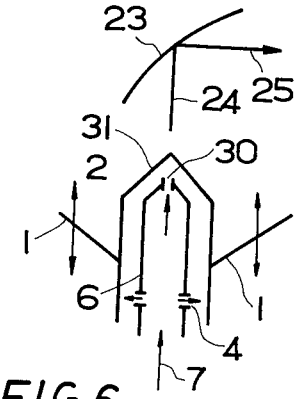
FIG. 4 is a schematically sectional view showing a speaker's construction, which is a second embodiment of this invention.

A speaker shown in FIG. 4 comprises a cylindrical hollow member 2 having a forward conical portion 31. The cylindrical member 2 is vertically located coaxially over a vertical hollow column 6 which is provided with an opening 30 formed at the tip thereof in addition to such side openings 4 as mentioned hereinbefore. In such an arrangement, the cylindrical member 2 is mainly supported by a flow of air which is discharged from the tip opening 30 of the column 6. A flow of air from the side openings 4 will effect the secondary support of the cylindrical member 2.

A cone-shaped, vibrating plate 1 which is mounted on the cylindrical member 6 produces sounds, in the same manner as previously described, which are reflected forwardly by a curved reflecting plate 23 as shown by 24 and 25 in FIG. 4.

Figure 5:
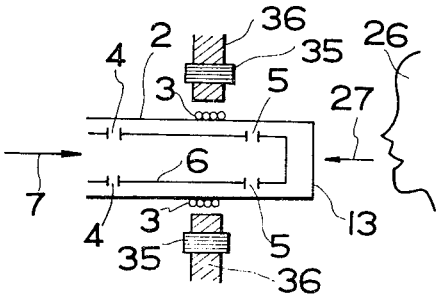
FIG. 5 is a schematically sectional view showing the construction of a microphone to which the principle of this invention is applied.

FIG. 5 shows a microphone construction to which this invention is applied. The microphone has substantially the same construction as that shown in the previous embodiments of the speaker except that the microphone comprises a cylindrical member 2 made to vibrate by the voice 27 of a human 26 and magnets 36 having coils 35. The cylindrical member 2 is similarly floated up from the column 6 by air flows which are discharged through the openings 4 and 5. When the cylindrical member 2 is vibrated by the voice 27 which impinges against the end plate 13 of the cylindrical member 2, the coil 3 thereon cooperates with the magnets 36 to convert the mechanical vibration of the cylindrical member 2 into an electrical vibration in the magnets 36.

Although the microphone is shown as a dynamic type in FIG. 5, this invention can be applied to any other type of microphone such as a capacitor type and the like.

Figure 6:
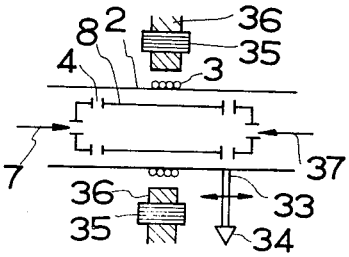
FIG. 6 is a schematically sectional view showing the construction of a cartridge for electric gramophones, to which the same principle of this invention is applied.

FIG. 6 shows a cartridge for electric gramophones to which this invention is applied. This cartridge comprises a cylindrical member 2 opened at the opposite ends thereof which is located over a hollow column 6. The column 6 receives air thereinto at the opposite end openings as shown by arrows 7 and 37 and discharges the received air from the side openings 4. Thus, the cylindrical member 2 is floated up coaxially from the column 6. The coil 3 cooperates with the magnets 36 having the coils 35 to convert a mechanical vibration of the cylindrical member 2 into an electrical vibration in the magnet 36. The mechanical vibration in the cylindrical member 2 is produced by a needle 33 fixed thereto which is engaged at 34 and operated by any rotating disc (not shown) as shown by a double-headed arrow. This cartridge is of MC type, but may be of any other type such as MM type and the like.

Figure 7:
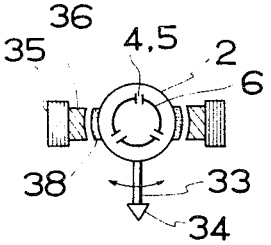
FIG. 7 is a schematically sectional view showing a cartridge constructed according to this invention which is different from that shown in FIG. 6.

A cartridge shown in FIG. 7 is distinguished from the cartridge shown in FIG. 6 in that it is rotated while vibrating around the axis of the column 6 by swinging the needle 33 as shown by a double-headed arrow. Magnets 38 on the cylindrical member cooperate with the magnets 36 to convert the vibratory rotation of the cylindrical member 2 into an electrical vibration in the magnets 36.

Figure 8:
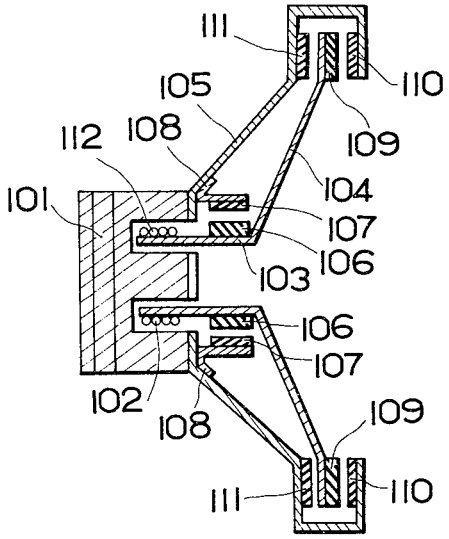
FIG. 8 is a schematic view showing an acoustic speaker constructed according to another aspect of this invention.

FIG. 8 shows a speaker construction distinguished from that shown in the previous embodiments of FIGS. 1 through 4 in that is is floated up from the main body of the speaker by utilizing a magnetic force. The speaker comprises a magnet 101 on which a cone-shaped basket 105 is firmly mounted in a well-known manner. The basket 105 has at its outer periphery an angular receiving member which is a C-shape in section. Permanent magnets 110 and 111 are disposed respectively on the insides of axially opposed wall portions of the receiving member. Between these permanent magnets 110, 111 there is located the outer periphery of a cone-shaped vibrating plate 104. This outer periphery is provided with permanent magnets 109 which are positioned intermediately between the permanent magnets 110 and 111 in a spaced relationship relative to these magnets 110 and 111 under the repulsion of the magnet.

The cone-shaped, vibrating plate 104 includes a bobbin 103 which has permanent magnets 106 mounted on the outer periphery thereof. These magnets 106 are located opposed to corresponding permanent magnets 107 which are fixed to the basket 105 by means of the respective fixtures 108. Therefore, the vibrating plate 104 is floated up from the main body of the speaker without contact therewith under the repulsion of the magnet.

As being well known in the art, a voice coil 102 is mounted on the bobbin 103 of the vibrating plate 104 around the outer periphery thereof. This voice coil 102 converts an electrical vibration in the magnet 101 into a mechanical vibration of the vibrating plate 104 in a well-known manner.

Figure 9:
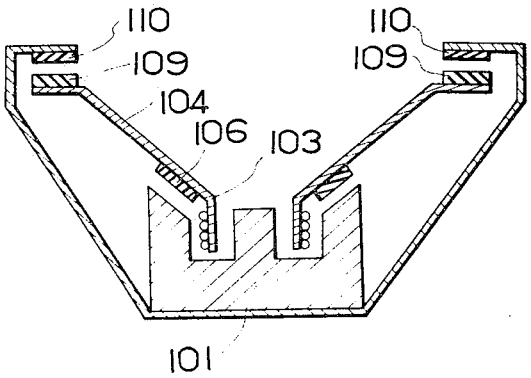
FIG. 9 is a view similar to FIG. 8, showing a modification of the construction shown in FIG. 8.

In such a construction as shown in FIG. 9, a cone-shaped, vibrating plate 104 is floated up only under the magnetic repulsion between the magnets 109 and 110 and between the magnets 101 and 106. The magnets 106 are located opposed to the sloping surface formed on the acoustic magnet 101 of the speaker.

Figure 10:
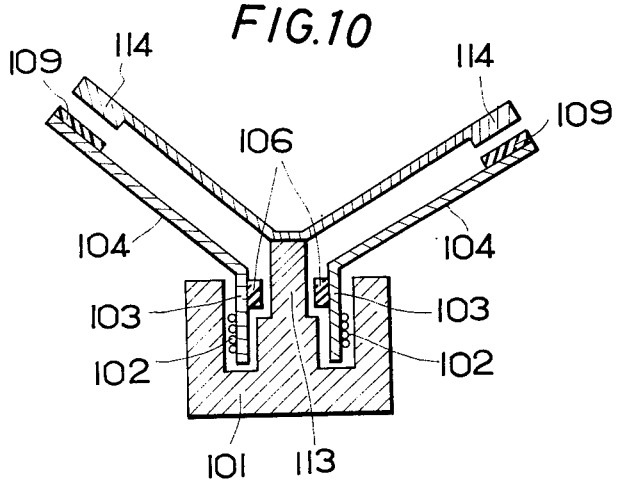
FIG. 10 is a view similar to FIG. 8, showing a further modification of the construction shown in FIG. 9.

FIG. 10 shows a more simplified construction of the speaker to which this invention is applied. In this construction, the acoustic magnet 101 has a central projecting portion 113 the outer end of which has a cone-shaped yoke 114 mounted thereon. The cone-shaped vibrating plate 104 includes permanent magnets 106 and 109 which are held away from the projecting portion 113 and yoke 114 under their magnetic repulsion. In such a construction, the acoustic magnet 101 serves not only to drive the voice coil 102, but also to float up the cone-shaped vibrating plate 104.

Figure 11:
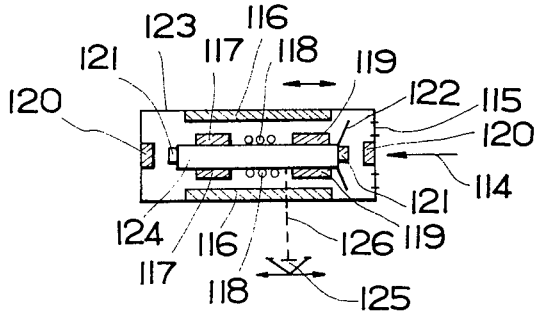
FIG. 11 is a schematic view showing a microphone constructed by applying thereto the same aspect as in FIG. 8, 9, 10, this embodiment being able to be utilized as a cartridge for electric gramophones.

FIG. 11 shows a microphone to which this invention is applied. The microphone includes a case 123 having forward and rearward end plates, the forward end plate being perforated as shown by 115 in FIG. 11.

Magnets 116 are mounted on this inner side wall of the case 123. Similarly, magnets 120 are mounted on the inner wall of the end plates. A vibrating member 124 which has magnets 117, 119 and 121 mounted thereon at positions opposing the respective magnets 116 and 120 is disposed within the case 123. The vibrating member 124 includes a vibrating plate 122 mounted thereon at the forward end and a coil 118 located around the vibrating member 124 between the opposite ends thereof. The coil 118 serves to convert a mechanical vibration of the vibrating member 124 into an electrical vibration in the magnets 116.

Thus, the vibrating member 124 is floated up within the case 123 under the magnetic repulsion so that the vibrating member 124 will be made to vibrate by any vibration in the air which is received by the vibrating plate 122.

The construction shown in FIG. 11 may be used as a cartridge for electric gramophones if a needle 125 is mounted on the vibrating member 124 by means of an arm 126 as shown by a dotted line in FIG. 11. In this case, the vibrating member 124 is made to vibrate through the needle 125 which is swung by engaging with a rotating music disc.

Figure 12:
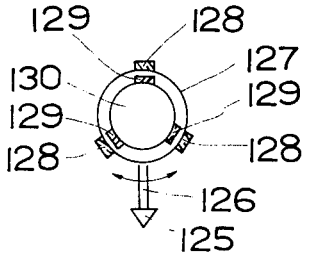
FIG. 12 is a schematic view showing a cartridge of this invention which is different from that shown in FIG. 11.

In a cartridge illustrated in FIG. 12, a cylinder 127 is disposed over a fixed supporting member 130 with a needle 125 mounted on the cylinder 127 by means of an arm 126. The cylinder 127 includes three magnets disposed around the outer periphery thereof in a spaced relationship with each other. The supporting member 130 also includes three magnets 129 disposed around the outer periphery thereof at locations corresponding to the magnets 128 on the cylinder 127. There is magnetic attraction between the magnets 128 and 129 so that the cylinder 127 is floated up from the supporting member 130 and always returned to its original position under the magnetic attraction acting between the magnets 128 and 129. It is noted that the cylinder 127 is rotated around the axis of the supporting member 130 as shown by a double-headed arrow by engaging the needle 125 within the groove of a rotating music disc.

Figure 13:
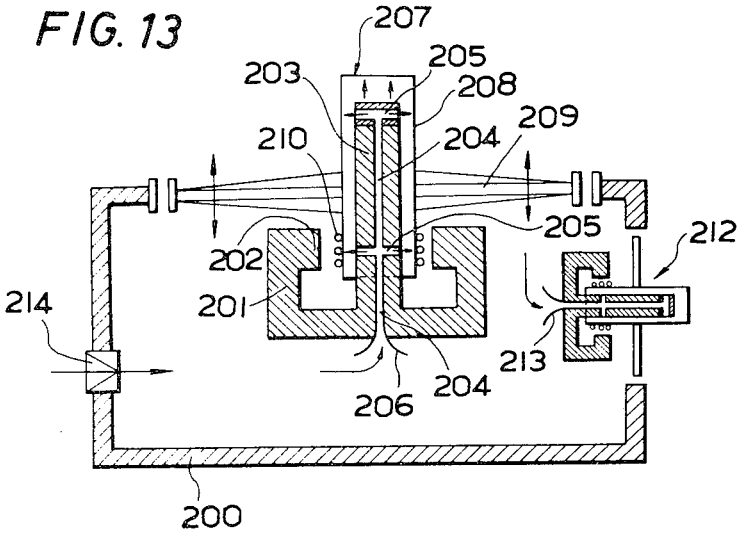
FIG. 13 is a sectional view showing an improvement of the speakers shown in FIGS. 1 to 4 in which an external means for supplying air to the speakers is not used.

A speaker system shown in FIG. 13 includes air pressure-producing means contained therein, rather than external air-supplying means such as a compressor which is used in the embodiments shown in FIGS. 1 to 4. The speaker system comprises a closed box 200 within which a magnet 201 and vibrating plate 209 for producing sounds with a lower frequency is mounted. The magnet 201 is combined with yoke 202 and a supporting column 203 extending outwardly beyond the annular yoke 202. The supporting column 203 has an air passage 204 extending centrally therethrough and side openings 205 provided on the column at the tip and intermediate portions thereof to connect with the air passage 204. Furthermore, the air passage 204 has a flared element 206 for introducing air into the air passage 204.

Over the supporting column 203 is placed a vibrating portion 207 which includes a cylindrical bobbin 208 placed on the column 203 to cover the side openings 205 and a vibrating plate 209 attached to the bobbin 208. Further, a voice coil means 210 is mounted on the inner end of the bobbin 208 around the outer periphery thereof and positioned to cooperate with the annular yoke 202 of the magnet 201.

In such an arrangement, the air within the box 200 can be compressed as the vibrating plate 209 is oscillated by the cooperation of the annular yoke 202 with the voice coil means 210 on the bobbin 208. The compressed air in the box 200 is inducted into the air passage 204 of the column 203 through the flared element 206 and then discharged from the air passage 204 to the interior of the bobbin 208 through the side openings 205. Thus, the vibrating device 207 can be floated up from the supporting column 203 by the pressure of air which has been discharged from the side openings 205 of the column 203.

As seen from FIG. 13, the speaker system includes a further vibration device 212 for producing sounds with for example a higher frequency, which device is of the same structure as that of the vibrating device 207. The vibrating device 212 is also floated by compressed air in the box 200 which is generated by vibrating plate 209. Therefore, the vibrating device 212 can be operated in a like manner as in the vibrating device 207.

Additional air can be supplied to the closed box 200 through a check valve 214 on the wall thereof which permits the air to flow into the box 200.

Figure 14:
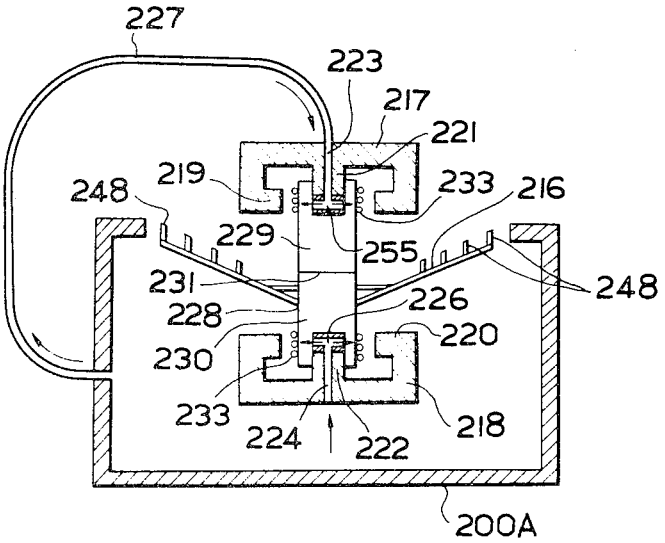
FIG. 14 is another embodiment of the present invention, wherein 2 sets of coils and magnets to push-pull the vibrating cone are employed.

FIG. 14 shows a speaker system which includes a pair of opposed magnets 217 and 218 and coils. Each of the magnets is provided with an annular yoke 219 or 220 and a central yoke 221 or 222 as in the embodiment shown in FIG. 14. The central yoke 221 or 222 includes an air passage 223 or 224 extending therethrough and a transverse mozzle 225 or 226 formed in the top end of the yoke 221 or 222 and connecting with the respective air passages 223 or 224. The air passage 223 of the magnet 217 is connected with the interior of the closed box 200A by means of a pipe 227.

A vibrating device 216 includes a cylindrical bobbin 228 placed at its opposite ends over the aligned central yoke 221 and 222 of the magnets 217 and 218. The bobbin 228 is divided into two chambers 229 and 230 by a partition 231, which chambers receive air from the transverse nozzle 225 and 226 of the respective yokes 221 and 222.

The vibrating device 216 also includes a vibrating plate 232 mounted on the bobbin 228 at the intermediate portion thereof. The ribs 248 are provided in the vibrating plate 232 for reinforcement.

Similarly, the bobbin 228 includes voice coils 233 mounted on the opposite ends thereof at such a position that they are opposed to the respective annular yokes 219 and 220 of the magnets 217 and 218.

As described previously, the air within the box 200A is compressed as the vibrating cone 216 is oscillated by the voice coils 233 between the annular yokes 219, 220 and center yoke 225, 226. The compressed air is inducted into the air passage 224 of the magnet 218 and into the air passage 223 of the magnet 217 through the pipe 227 and then discharged from these air passages 223, 224 into the respective chambers 229, 230 through the transverse passages 225, 226 so that the vibrating cone 216 will be floated up between the central yoke 221 and 222 of the magnets 217 and 218.

Figure 15:
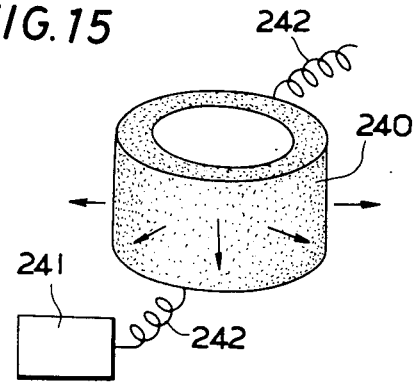
FIG. 15 is a perspective view of a vibrating element to be used in FIGS. 16 and 17.
Figure 16:
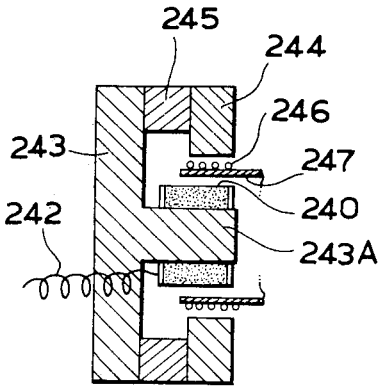
FIG. 16 is a sectional view showing a speaker in which the vibrating element in FIG. 15 is utilized in order to eliminate compressor in FIGS. 1 to 4.
Figure 17:
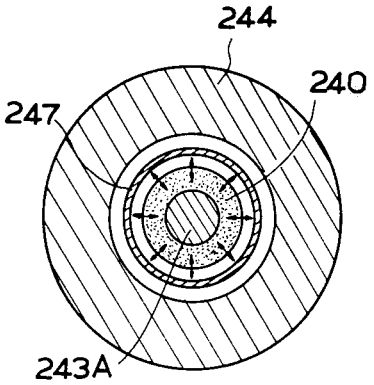
FIG. 17 is a sectional view in a plane perpendicular to that of FIG. 16.

FIGS. 15, 16 and 17 illustrate a still further embodiment of this invention in which a cylindrical vibrating member 240 made from piezo electricity material such as ferrite, ceramic or the like is utilized. Such a vibrating member is oscillated radially as shown by arrows in FIG. 15 when a high frequency, such as 20,000 Hz, is applied thereto by any suitable high-frequency producing means 241 through conductive wire 242.

The vibrating member 240 is mounted surrounding the center yoke 243A of a main yoke 243 having T-shaped section. The main yoke 243 includes a ring yoke 244 mounted thereon through a ring ferrite magnet 245. The ring yoke 244 cooperates with the voice coil 246 on a bobbin 247 of the speaker system.

When a high frequency, such as 20,000 Hz, is applied to the vibrating member 240 through the conductive wire 242, the vibrating member 240 is is oscillated radially inside the bobbin 247 to compress the air and form a high pressure layer (squeezed firm) in an annular space between the outer periphery of the vibrating member 240 and the inner periphery of the bobbin 247. Thus, the bobbin 247 is floated up around the vibrating member 240 by means of the compressed air between the bobbin 247 and the vibrating member 240.

Although the preferred embodiments of this invention have been described hereinbefore, various changes and modifications may be carried out by those skilled in the art in line with the spirit and scope of the invention as defined in attendant claims.

I claim:

1. Acoustic device comprising: a main body having a magnet attached thereto, a vibrating means disposed to cooperate with the magnet of said main body for converting an electrical vibration into a mechanical vibration or vice versa, and a means for floating up said vibrating means to disengage from said main body.

2. Acoustic device as defined in claim 1 wherein said device is an acoustic speaker and wherein said vibrating means comprises a cone-shaped vibrating plate floated up from said main body by the action of said floating means and a voice coil means mounted on said vibrating plate for cooperating with the magnet of said main body to convert an electrical vibration in said magnet into a mechanical vibration in said cone-shaped vibrating plate.

3. Acoustic device as defined in claim 1 wherein said device is a microphone, and wherein said vibrating means comprises: a movable member floated up from said main body by the action of said floating means, said movable member being adapted to effect the vibratory movement thereof as it is impinged by any sound in the air, and means on said movable member for cooperating with the magnet of said main body to convert the vibratory movement of said movable member into an electrical vibration in said magnet.

4. Acoustic device as defined in claim 1 wherein said device is a cartridge for electric gramophones and wherein said vibrating means comprises: a movable member floated up from said main body by the action of said floating means, a needle attached to said movable member, and means on said movable member for cooperating with the magnet of said main body to convert a mechanical vibration in said movable member which is transmitted thereto from said needle into an electrical vibration in the magnet of said main body.

5. Acoustic device as defined in claim 2 wherein said cone-shaped vibrating plate has at its apex a cylindrical hollow portion and wherein said floating means comprises means for supplying a uniform flow of air into said hollow portion to hold said vibrating plate away from said main body under the action of said uniform flow of air.

6. Acoustic device as defined in claim 2 wherein said floating means comprises magnet means for holding said vibrating plate away from said main body under the influence of magnetic force.

7. Acoustic device as defined in claim 3 wherein said movable member is a cylindrical hollow tube and wherein said floating means comprises means for supplying a uniform flow of air into said cylindrical hollow tube to hold it away from said main body under the influence of said flow of air.

8. Acoustic device as defined in claim 3 wherein said movable member is a cylindrical hollow tube and wherein said floating means comprises magnet means for holding said cylindrical hollow tube away from said main body under the influence of magnetic force.

9. Acoustic device as defined in claim 4 wherein said movable member is a cylindrical hollow tube and wherein said floating means comprises means for supplying a uniform flow of air into said cylindrical hollow tube to hold it away from said main body under the influence of said flow of air.

10. Acoustic device as defined in claim 4 wherein said floating means comprises magnet means for holding said movable member away from said main body under the influence of magnetic force.

11. Acoustic device as defined in claim 1 wherein said device is an acoustic speaker and wherein said vibrating means comprises a sound-producing vibrating plate floated up from said main body by the compressed air generated by the movement of the above vibrating device.

12. Acoustic device as defined in claim 1 wherein said device is an acoustic speaker and wherein said vibrating means comprises a sound-producing vibrating plate floated up from said main body by the action of the vibrating member made from such a material that it is oscillated when a high frequency is applied thereto, by this means, the compressed air film layer (the squeezed film) is formed to separate said vibrating member and said main body in order to float said vibrating member when it is oscillated by the high frequency voltage applied thereto.

* * * * *